US010983464B2

(12) United States Patent
Nakashima et al.

(10) Patent No.: US 10,983,464 B2
(45) Date of Patent: Apr. 20, 2021

(54) IMAGE HEATING DEVICE WITH FIRST AND SECOND GROUPS OF CONDUCTORS HAVING DIFFERENT WIDTHS, AND IMAGE FORMING APPARATUS

(71) Applicant: CANON KABUSHIKI KAISHA, Tokyo (JP)

(72) Inventors: Yusuke Nakashima, Yokohama (JP); Teruhiko Namiki, Mishima (JP); Takao Kawazu, Susono (JP); Ryota Ogura, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/820,877

(22) Filed: Mar. 17, 2020

(65) Prior Publication Data

US 2020/0301329 A1 Sep. 24, 2020

(30) Foreign Application Priority Data

Mar. 19, 2019 (JP) ..... JP2019-051895

(51) Int. Cl.
*G03G 15/20* (2006.01)

(52) U.S. Cl.
CPC ..... *G03G 15/2053* (2013.01); *G03G 15/2042* (2013.01); *G03G 15/2064* (2013.01); *G03G 2215/2025* (2013.01)

(58) Field of Classification Search
USPC ..... 399/329
See application file for complete search history.

(56) References Cited

U.S. PATENT DOCUMENTS

2014/0169845 A1* 6/2014 Nakahara ..... G03G 15/2053 399/328
2019/0137913 A1* 5/2019 Jinkoma ..... G03G 15/2039
2020/0150566 A1 5/2020 Fujiwara et al.

FOREIGN PATENT DOCUMENTS

JP 2001006846 A 1/2001
JP 2002299016 A 10/2002
JP 2002373767 A 12/2002
JP 2004146107 A 5/2004

OTHER PUBLICATIONS

Co-pending U.S. Appl. No. 16/715,313, filed Dec. 16, 2019.

* cited by examiner

*Primary Examiner* — Q Grainger
(74) *Attorney, Agent, or Firm* — Venable LLP

(57) ABSTRACT

A plurality of electric conductors provided on a substrate of a heater of an image heating device has a conductor group A including a plurality of first electric conductors and a conductor group B including a plurality of second electric conductors. The plurality of first electric conductors each have a first portion having a width W1 and a second portion having a width W2 smaller than the width W1, are provided on the substrate to be arranged side by side in a width direction. The plurality of second electric conductors each have a width W3 larger than the width W2, are provided on the substrate to be arranged side by side in a width direction so as to partially overlap the second portion.

14 Claims, 8 Drawing Sheets

NORMAL STATE

STATE 1 WHEN PRINTING SHIFT HAS OCCURRED

STATE 1 WHEN PRINTING SHIFT HAS OCCURRED

NORMAL STATE

STATE WHEN PRINTING SHIFT HAS OCCURRED

IMAGE HEATING DEVICE WITH FIRST AND SECOND GROUPS OF CONDUCTORS HAVING DIFFERENT WIDTHS, AND IMAGE FORMING APPARATUS

BACKGROUND OF THE INVENTION

Field of the Invention

The present invention relates to an image heating device such as a fixing device installed in an image forming apparatus such as a copying machine or a printer using an electrophotographic method or an electrostatic recording method, a gloss-imparting device that increases the gloss of a toner image by reheating the fixed toner image on a recording material, and the like.

Description of the Related Art

A conventional image heating device provided in an image forming apparatus includes a tubular film called an endless belt or an endless film, a flat heater in contact with an inner surface of the film, and a roller for forming, together with the heater, a nip portion through the film. The heater of this image heating device is configured of an insulating ceramic substrate, a heating resistor formed by printing on the substrate, and a temperature detecting element. A configuration in which power supply to a heating resistor is controlled so that a nip portion assumes a predetermined temperature (appropriate toner image heating temperature) based on temperature information detected by the temperature detecting element has been proposed (Japanese Patent Application Publication No. 2002-373767). Here, where small-size paper is continuously printed in the image forming apparatus equipped with such image heating device, a phenomenon that the temperature of a region where the paper does not pass in the longitudinal direction of the nip portion gradually rises (non-paper passing portion temperature rise) may occur. Where the temperature of the non-paper passing portion becomes too high, components in the apparatus may be damaged.

SUMMARY OF THE INVENTION

A method in which a plurality of temperature detecting elements is provided on a heater, and separate elements are used for temperature control and for temperature detection of a non-paper passing portion is used as a means for solving the above problem. However, as the number of temperature detecting elements formed on a ceramic substrate increases, the number of conductors connected to the temperature detecting element increases, and the space between the conductors becomes smaller in the ceramic substrate of a limited size. Furthermore, when connecting a conductor to an element or metal such as a temperature detecting element or an electrode, the conductor material to be used needs to be changed depending on the compatibility of the conductor material of the conductor and the element or metal to be connected thereto (abnormal change in element characteristics, poor contact, and the like). When the conductor material to be used is expensive, a conductor pattern is formed of two or more types of conductor materials, and a distance between adjacent conductors cannot be ensured due to a displacement occurring when forming each conductor. Where an appropriate distance cannot be ensured between adjacent conductors, there is a concern that problems such as short-circuiting, migration, and poor voltage resistance between adjacent conductors may occur.

An object of the present invention is to provide a technique capable of reducing the size of a heater while suppressing short-circuiting, migration, and poor voltage resistance between adjacent conductors.

To achieve the above object, the heater of the present invention includes:

a substrate;

a heating resistor provided on the substrate, and a plurality of electric conductors provided on the substrate, wherein the plurality of electric conductors include a conductor group A including a plurality of first electric conductors and a conductor group B including a plurality of second electric conductors;

wherein the plurality of first electric conductors each have a first portion having a width W1 and a second portion having a width W2 smaller than the width W1 and are provided on the substrate to be arranged side by side in a width direction of the substrate; and wherein the plurality of second electric conductors each have a width W3 larger than the width W2 and are provided on the substrate to be arranged side by side in the width direction so as to partially overlap the second portion.

To achieve the above object, the image heating device of the present invention includes:

a heating unit having a heater for heating an image formed on a recording material, wherein the heater has a substrate, a heating resistor provided on the substrate, and a plurality of electric conductors provided on the substrate, wherein the plurality of electric conductors include a conductor group A including a plurality of first electric conductors and a conductor group B including a plurality of second electric conductors;

wherein the plurality of first electric conductors each have a first portion having a width W1 and a second portion having a width W2 smaller than the width W1 and are provided on the substrate to be arranged side by side in a width direction of the substrate; and wherein the plurality of second electric conductors each have a width W3 larger than the width W2 and are provided on the substrate to be arranged side by side in the width direction so as to partially overlap the second portion.

To achieve the above object, the image forming apparatus of the present invention includes:

an image forming unit that forms an image on a recording material; and a fixing unit for heating the image to fix the image on the recording material, wherein the fixing unit is an image heating device that has a heating unit having a heater for heating an image formed on a recording material, the heater has a substrate, a heating resistor provided on the substrate, and a plurality of electric conductors provided on the substrate, and heats an image formed on a recording material using heat of the heater;

wherein the plurality of electric conductors include a conductor group A including a plurality of first electric conductors and a conductor group B including a plurality of second electric conductors;

wherein the plurality of first electric conductors each have a first portion having a width W1 and a second portion having a width W2 smaller than the width W1, are provided on the substrate to be arranged side by side in a width direction; and wherein the plurality of second electric conductors each have a width W3 larger than the width W2, are provided on the substrate to be arranged side by side in a width direction so as to partially overlap the second portion.

According to the present invention, it is possible to reduce the size of the heater while suppressing short-circuiting, migration, and poor voltage resistance between adjacent conductors.

Further features of the present invention will become apparent from the following description of exemplary embodiments with reference to the attached drawings.

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

Embodiment 1

1. Configuration of Image Forming Apparatus

Figure 1:
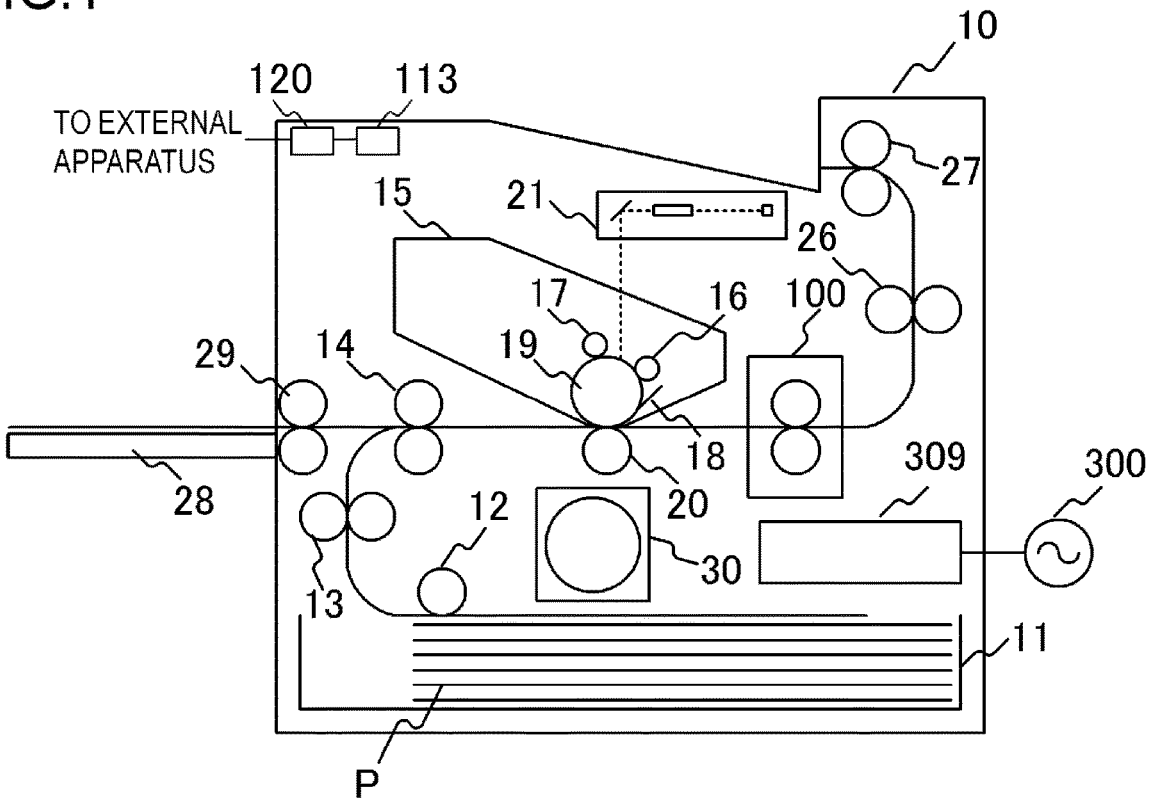
FIG. 1 is an explanatory diagram of the image forming apparatus according to Embodiment 1.

FIG. 1 is a schematic sectional view of the image forming apparatus according to an embodiment of the present invention. Examples of the image forming apparatus to which the present invention is applicable include a copying machine, a printer and the like using an electrophotographic method or an electrostatic recording method. Here, a case is described in which the present invention is applied to a laser printer in which an image is formed on a recording material P by using an electrophotographic method.

An image forming apparatus 10 includes a video controller 120 and a control unit 113. The video controller 120 serves as an acquisition unit for acquiring information on an image formed on a recording material and receives and processes image information and a print instruction transmitted from an external device such as a personal computer. The control unit 113 is connected to the video controller 120, and controls each unit constituting the image forming apparatus 10 according to an instruction from the video controller 120. Where the video controller 120 receives a print instruction from the external device, image formation is performed by the following operations.

Where a print signal is generated, a scanner unit 21 emits a laser beam modulated according to image information, and scans the surface of a photosensitive drum 19 charged to a predetermined polarity by a charging roller 16. As a result, an electrostatic latent image is formed on the photosensitive drum 19. By supplying toner from a developing roller 17 to the electrostatic latent image, the electrostatic latent image on the photosensitive drum 19 is developed as a toner image (toner image). Meanwhile, the recording material (recording paper) P loaded on a paper feed cassette 11 is fed one by one by a pickup roller 12 and is conveyed toward a registration roller pair 14 by a conveyance roller pair 13. Further, the recording material P is conveyed from the registration roller pair 14 to a transfer position at a timing when the toner image on the photosensitive drum 19 reaches a transfer position formed by the photosensitive drum 19 and a transfer roller 20. As the recording material P passes through the transfer position, the toner image on the photosensitive drum 19 is transferred to the recording material P. Thereafter, the recording material P is heated by a fixing device (image heating device) 100 as a fixing unit (image heating unit), and the toner image is heated and fixed on the recording material P. The recording material P carrying the fixed toner image is discharged to a tray above the image forming apparatus 10 by a pair of conveying rollers 26, 27. A drum cleaner 18 cleans toner remaining on the photosensitive drum 19. A paper feed tray 28 (manual tray) having a pair of recording material regulating plates adjustable in width according to the size of the recording material P is provided to accommodate recording materials P of sizes other than the standard size. The pickup roller 29 feeds the recording material P from the paper feed tray 28. The image forming apparatus 10 includes a motor 30 that drives the fixing device 100 and the like. A CPU 309 serving as a heater driving unit and a power supply control unit connected to a commercial AC power supply 300 controls power supply to the fixing device 100. The above-described photosensitive drum 19, charging roller 16, scanner unit 21, developing roller 17, and transfer roller 20 constitute an image forming unit that forms an unfixed image on the recording material P.

Figure 2:
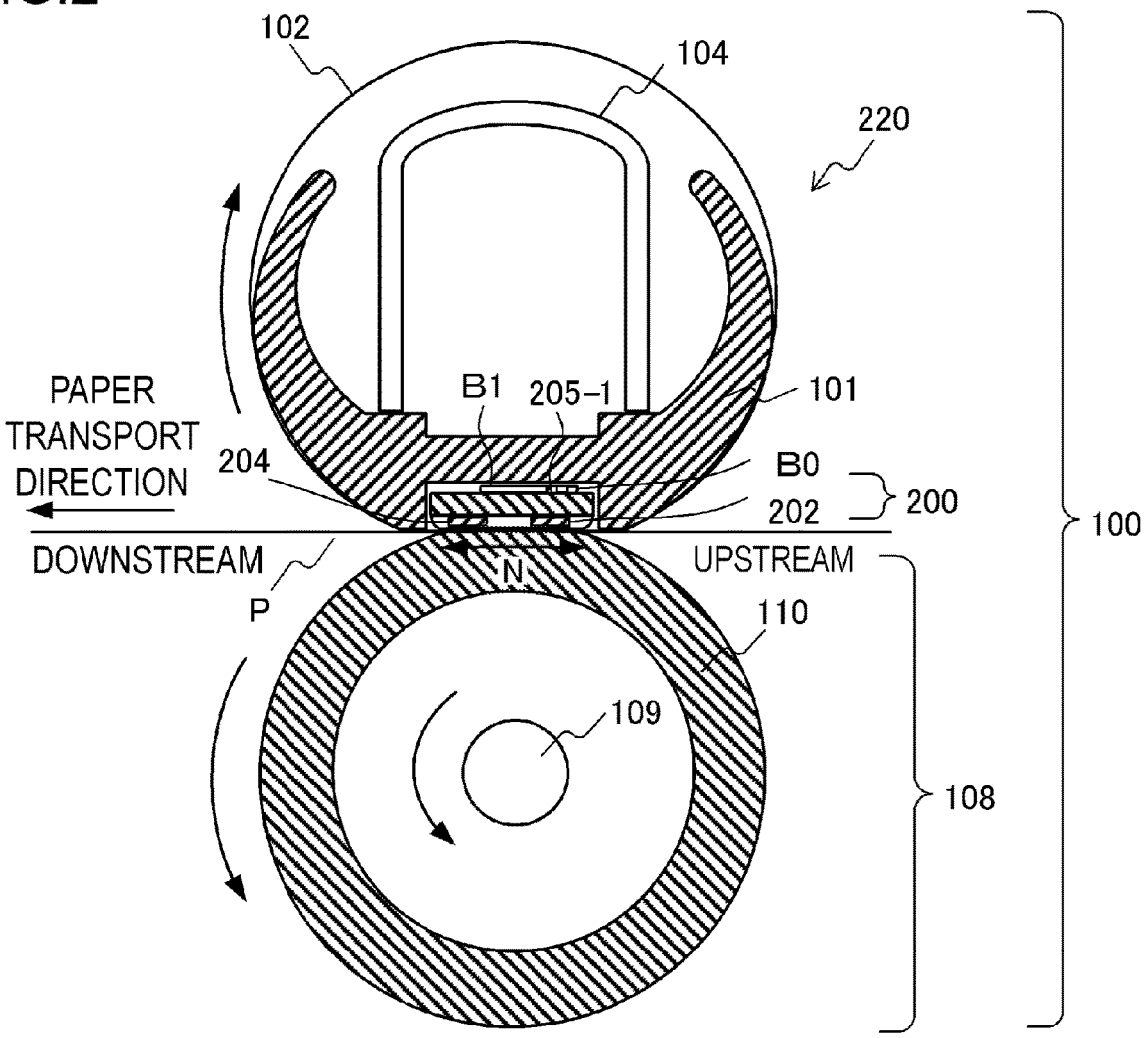
FIG. 2 is an explanatory diagram of the image heating device according to Embodiment 1.

FIG. 2 is a schematic sectional view of the fixing device 100 according to the present embodiment. The fixing device 100 includes a fixing film (hereinafter, referred to as a film) 102, a heater 200 that contacts the inner surface of the film 102, a pressure roller 108 that forms a fixing nip portion N with the heater 200 through the film 102, and a metal stay 104.

The film 102 is a heat-resistant film that is formed in a tubular shape and called an endless belt or an endless film, and the material of a base layer is a heat-resistant resin such as a polyimide or a metal such as stainless steel. Further, an elastic layer such as heat-resistant rubber may be provided on the surface of the film 102. The pressure roller 108 has a metal core 109 made of a material such as iron or aluminum, and an elastic layer 110 made of a material such as silicone rubber. The heater 200 is held by a holding member 101 made of a heat-resistant resin. The holding member 101 also has a guide function for guiding the rotation of the film 102. The metal stay 104 is configured to apply a pressure of a spring (not shown) to the holding member 101. The pressure roller 108 receives power from a drive source (not shown) and rotates in the direction of the arrow. The film 102 rotates following the rotation of the pressure roller 108. The recording paper P carrying the unfixed toner image is heated and fixed while being nipped and conveyed at the fixing nip portion N. A heating unit 220 being in contact with an inner surface of the film 102 includes the heater 200, the holding member 101, and the metal stay 104.

Figures 3A, 3B:
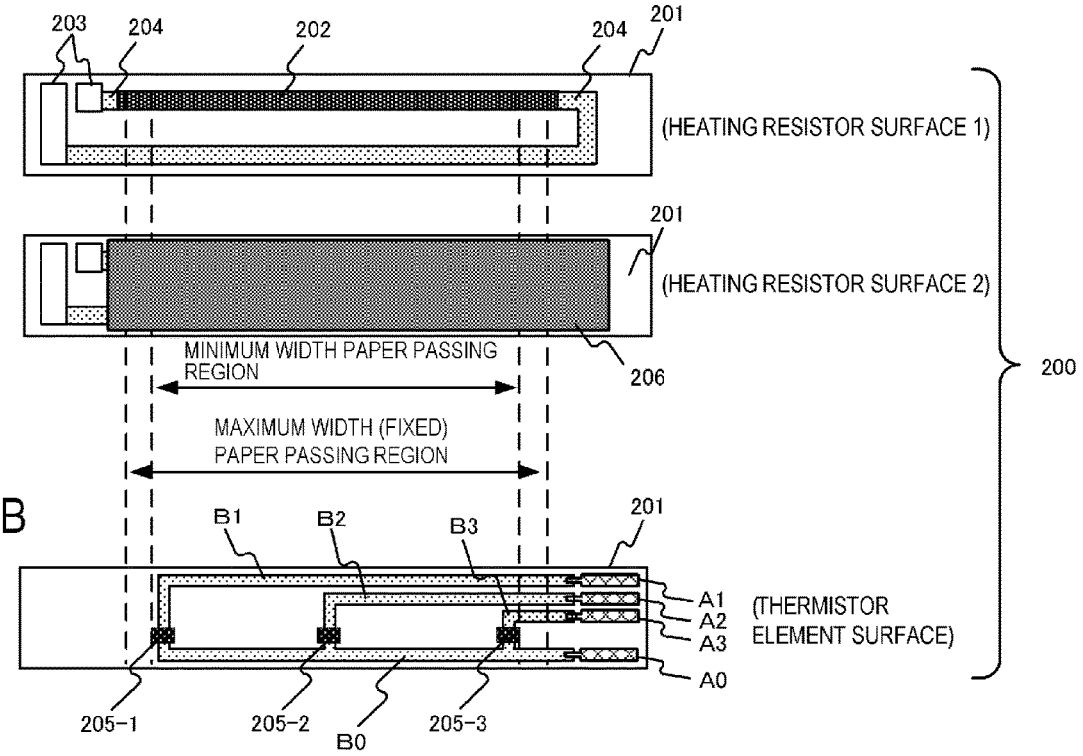
FIGS. 3A and 3B are explanatory diagrams of the image heating portion according to Embodiment 1.

FIGS. 3A and 3B each show a schematic configuration of the heater 200 as the image heating portion in the present embodiment.

FIG. 3A is a schematic plan view showing the configuration of the heater 200 on the heating resistor surface side. The heater 200 has an insulating substrate 201. A heating resistor 202 is formed by printing on one surface of the substrate 201 on the heating resistor surface side, and an electrode 203 and a conductor pattern 204 for feeding power to the heating resistor 202 are similarly formed by printing and connected to the respective ends of the heating resistor 202. Further, the heater 200 has a glass 206 as an insulating protective layer arranged so as to cover the heating resistor 202 and the conductive pattern 204 on the heating resistor surface side of the substrate 201. The heater 200 is arranged with respect to the fixing nip portion N (shown in FIG. 2) so as to be on the side of the fixing nip portion N.

FIG. 3B is a schematic plan view showing the configuration of the heater 200 on the side opposite to the heating resistor surface side (thermistor element surface side). On the surface side of the substrate 201 opposite to the heating resistor surface side, the thermistor elements 205-1, 205-3 for detecting a non-paper passing portion temperature increase and a thermistor element 205-2 for temperature control are formed by printing as a plurality of temperature detecting elements. Furthermore, conductors A0, A1, A2, A3 and conductors B0, B1, B2, B3 are formed by printing and connected to the thermistors 205-1 to 205-3 on the opposite surface side of the substrate 201 as conductor patterns of a plurality of electric conductors for extracting signals from each thermistor element. A conductor group A configured of the conductors A0 to A3 is formed by simultaneous printing by using a mask having a predetermined wiring pattern, and a conductor group B configured of the conductors B0 to B3 is also formed by simultaneous printing at a timing different from that of the conductor group A by using a mask having a predetermined wiring pattern.

Figure 4:
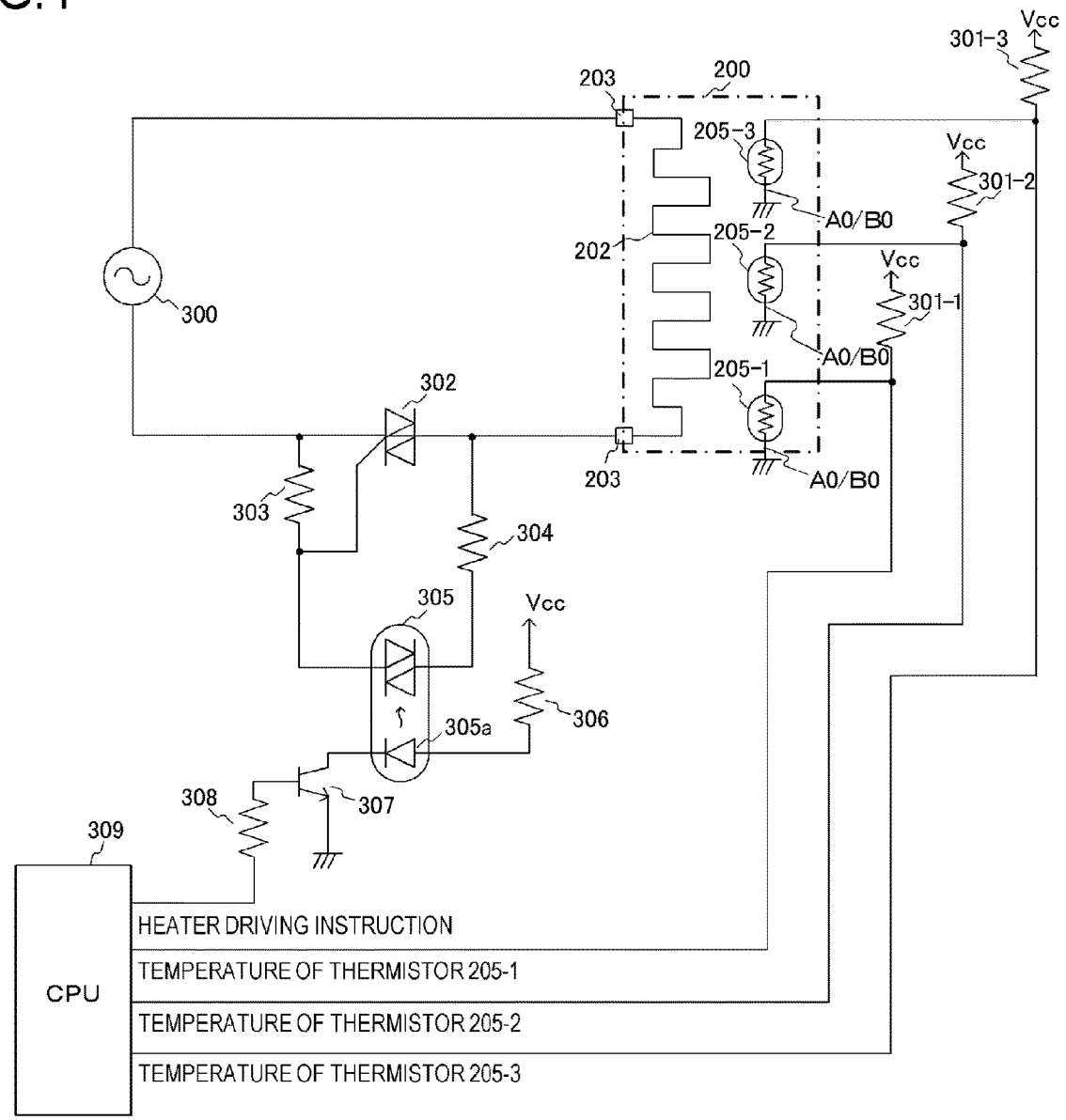
FIG. 4 is an explanatory diagram of the image heating portion driving circuit according to Embodiment 1.

FIG. 4 shows a schematic configuration of a heater drive circuit according to the present embodiment. In the drawing, a power supply voltage from a commercial AC power supply 300 is supplied to the heating resistor 202 to cause the heating resistor 202 to generate heat. Power is supplied to the heating resistor 202 by energizing/disconnecting a triac 302. Resistors 303, 304 are bias resistors for the triac 302, and a phototriac coupler 305 is a device for ensuring insulation between primary and secondary sides. By energizing a light-emitting diode 305*a* of the phototriac coupler 305, the triac 302 is turned on. The resistor 306 is for limiting the current of the light-emitting diode 305*a*, and turns ON/OFF the phototriac coupler 305 by a transistor 307. The transistor 307 operates according to a heater drive signal from the CPU 309 via a resistor 308. As for the temperature detected by the thermistors 205-1 to 205-3, a change in the resistance value of the thermistors 205-1 to 205-3 corresponding to the temperature change is detected as a divided voltage of the resistors 301-1 to 30-3 and inputted to the CPU 309 as an A/D-converted digital value. The CPU 309 outputs a heater driving instruction based on the inputted thermistor information, and controls the conduction state to the heating resistor 202.

Here, since the conductors of the conductor groups A, B are simultaneously formed by printing for each of the conductor groups, where a shift occurs during the printing, the conductors of each of the conductor groups A and B are shifted in the same direction.

The dimensional relationship in the connection portion where the thermistor conductors A1, A2 and the conductors B1, B2 in the heater 200 shown in FIGS. 3A and 3B are partially overlapped will be explained using FIGS. 5A to 5C and 6A and 6B.

Figure 5A:
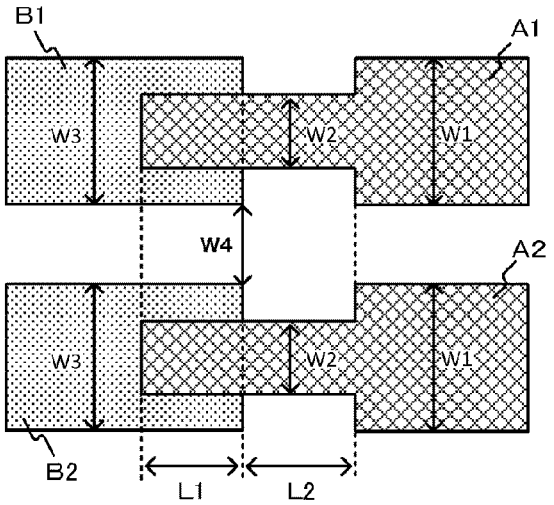
FIGS. 5A to 5C are explanatory diagrams of a conductor pattern shape on the insulating substrate in Embodiment 1.
Figure 5B:
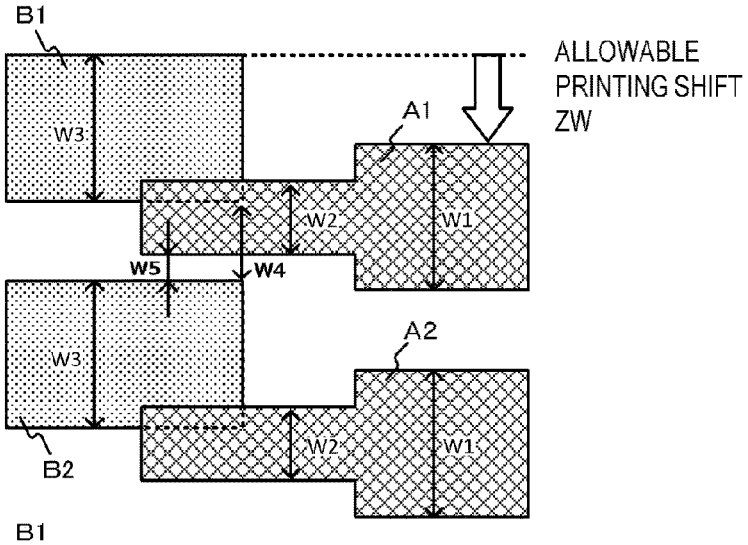
Figure 5C:
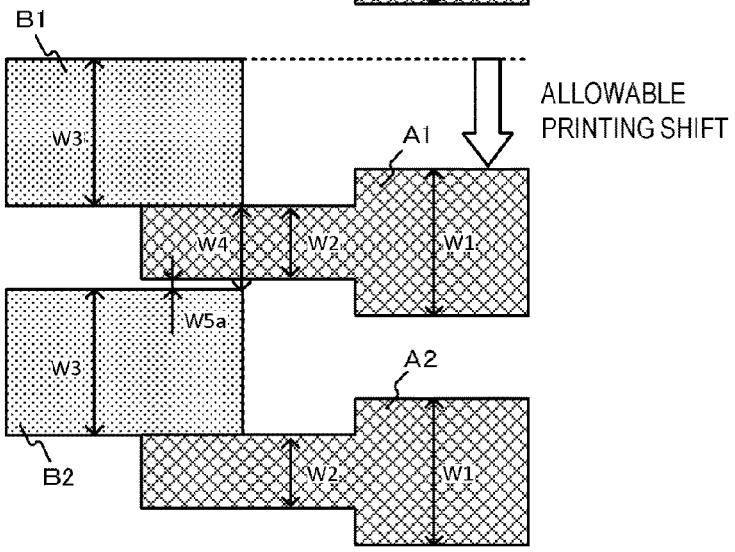

FIGS. 5A to 5C are schematic plan views showing an example of a conductor pattern shape on the insulating substrate in the present embodiment. FIG. 5A shows an arrangement in a normal state in which there is no shift between the conductor group A and the conductor group B, and FIGS. 5B and 5C show examples of the arrangement when a shift has occurred.

Figure 6A:
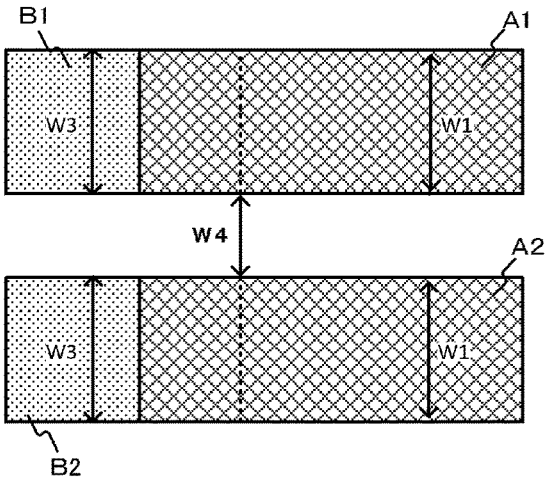
FIGS. 6A and 6B are explanatory diagrams of a conductor pattern shape of a comparative example.
Figure 6B:
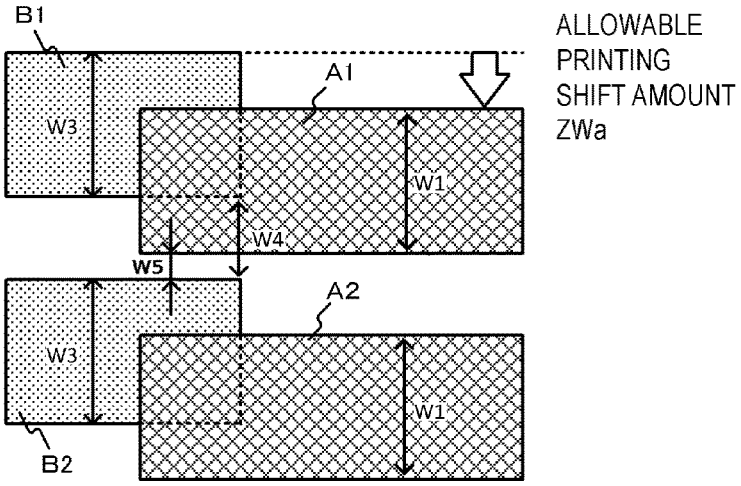

FIGS. 6A and 6B are schematic plan views showing an example of a conductor pattern shape on the insulating substrate in a comparative example. FIG. 6A shows an arrangement in a normal state in which there is no shift between the conductor group A and the conductor group B, and FIG. 6B shows an example of the arrangement when a shift has occurred.

The conductor groups A, B are arranged in the longitudinal direction of the substrate 201, and the conductors of the conductor groups A, B extend in the longitudinal direction of the substrate 201 at least at the connection portions. The width in the lateral direction orthogonal to the longitudinal direction of the substrate 201 is set so as to ensure a width that guarantees at least the minimum molding accuracy.

Further, the conductors of the conductor groups A, B are arranged in parallel in the respective conductor groups with an interval in the lateral direction of the substrate 201, and the conductors are arranged as densely as possible within a range where there is no influence of migration or the like with an adjacent conductor.

In the configuration of the present embodiment, the wiring direction for connection and extension of different conductors matches the longitudinal direction of the substrate 201, but such a configuration is not limiting. That is, in the configuration of the present embodiment, the conductor width of each conductor of the conductor groups A, B (the width in the direction orthogonal to the direction in which the conductors extend) matches the width of each conductor in the lateral direction of the substrate 201 at least at the connection portion, but this is not limiting for substrates of other configurations.

As shown in FIG. 5A, the conductors A1, A2 as the first electric conductors in the conductor group A which are formed by printing at the same timing include a first portion (main body portion) having a conductor width of W1, and a second portion (connection portion) having a conductor width of W2 smaller than the width W1. The conductors A1, A2 each have a tapered planar shape that extends toward the conductors B1, B2 so that the portion having the width W2 protrudes from the tip of the portion having the width W1, and are connected to the conductors B1, B2 at the portions having the width W2. The conductors A1, A2 are electrically connected to the conductors B1, B2 by overlapping a part of the portion having the width W2 on the conductors B1, B2. In the conductors A1, A2, the portion having the width W1 and the portion having the width W2 are arranged so that their centers in the conductor width direction coincide with each other (center reference).

Meanwhile, the conductors B1, B2 as the second electric conductors in the conductor group B which are simultaneously formed by printing at a timing different from that of the conductor group A have a conductor width of W3.

The timing of formation by printing may be such that the conductor group A is printed before the conductor group B, or the order of printing may be reversed.

In the configuration in which the conductor portion having the width W2 in the conductor group A and the conductor portion having the width W3 in the conductor group B overlap, the dimensional relationships between the widths W1, W2, and W3 are represented by the following Formulas 1 and 2.

$$W1>W2 \quad \text{(Formula 1)}$$

$$W3>W2 \quad \text{(Formula 2)}$$

The conductor configuration in the present example shown in FIG. 5A and the conductor configuration in the comparative example shown in FIG. 6A have the same center reference in the width direction of the widths W1 and W2, and W1=W3. The adjacent conductors B1, B2 in the conductor group B are formed by printing at an inter-conductor distance W4.

An arrangement example of the conductor group A and the conductor group B when a printing shift has occurred between the conductor group A and the conductor group B is shown in FIGS. 5B and 5C with respect to the present embodiment and in FIG. 6B with respect to the comparative example.

As shown in FIG. 5A, in the normal state in which no printing shift occurs between the conductor groups A, B, in the present embodiment, the portions of the conductors A1, A2 having the width W2 overlap with the conductors B1, B2 in the arrangement in which the portions of the conductors A1, A2 having the width W1 match the conductors B1, B2 in the width direction.

As shown in FIG. 6A, in the normal state, in the comparative example, the conductors A1, A2 and the conductors B1, B2 overlap in an arrangement in which the conductors match each other in the width direction.

Here, as shown in FIG. 5B, when the required inter-conductor distance between the conductor A1 overlapped with the conductor B1 and the adjacent conductor B2 is taken as a distance W5, an allowable printing shift ZW is expressed by the following formula.

$$ZW=(W3+W4)-(W2+W5+(W1-W2)/2)=W4-W5+(W1-W2)/2$$

Meanwhile, as shown in FIG. 6B, in the configuration of the comparative example, the allowable printing shift ZWa is expressed by the following formula.

$$ZWa=(W3+W4)-(W5+W1)=W4-W5$$

Since it follows from Formula 1 that W1>W2, the allowable printing shift ZW in the present embodiment is larger than the allowable printing shift ZWa in the configuration of the comparative example Therefore, as compared with the configuration of the comparative example, the configuration of the present embodiment can ensure the inter-conductor distance between of the conductor A1 and the adjacent conductor B2 even when a printing shift has occurred, and short-circuiting, migration, and poor voltage resistance between adjacent conductors can be prevented. That is, it is possible to reduce the size of the heater while suppressing short-circuiting, migration, and poor voltage resistance between adjacent conductors.

Here, FIG. 5C shows the arrangement of the conductor groups A and B when the maximum allowable shift has occurred. Where the inter-conductor distance W4 between the conductor B1 and the conductor B2 is set to be W4>W2 when the necessary inter-conductor distance W5 between the conductor A1 to be overlapped with the conductor B1 and the adjacent conductor B2 is W5a>0, it is possible to maximize the allowable printing shift. As shown in FIG. 5C, even when the conductor B1 and the portion of the conductor A1 having the width W2 do not overlap with each other, electrical conduction is ensured provided that the two conductors are adjacent so as to be in contact with each other.

The effect of expanding the printing shift ZW according to the present embodiment can be effectively obtained in a configuration that satisfies the relationship of W1+W5>W4.

In addition, by setting the reference in the width direction of the portion having the width W1 portion and the portion having the width W2 in the conductors A1, A2 to be the same center reference, the distance between the adjacent conductor patterns can be ensured even when a printing shift in the width direction of the conductor groups A and B occurs in both directions.

Further, as shown in FIG. 5A, the length in the length direction orthogonal to the width direction of the region where the portion of the conductor group A having the width W2 overlaps with the conductor group B is denoted by L1, and the length in the length direction of the region where the portion of the conductor group A having the width W2 does not overlap with the conductor group B is denoted by L2. The lengths L1 and L2 are set such that an electrical connection between the conductor group A and the conductor group B can be ensured even when a printing shift has occurred in the length direction.

The conductor group A may be formed of a material that is different from a material of the conductor group B, and such materials may be silver (Ag) and silver/palladium alloy (Ag/Pd). In this case, the materials to be used can be selected depending on the compatibility with electronic elements and metals such as thermistors and electrodes to be connected to the conductor groups A and B, and the occurrence of abnormal changes in element characteristics and poor contact can be suppressed.

Embodiment 2

Embodiment 2 of the present invention will be described with reference to FIG. 7. Here, only differences between Embodiment 2 and Embodiment 1 will be described. In Embodiment 2, description of items common to Embodiment 1 will be omitted.

Embodiment 2 is configured, similarly to Embodiment 1, so that a portion of the conductor A having the width W2 in the overlapped portion of the conductor group A and the conductor group B is smaller than the portions of the conductor groups A, B having the width W1, W3. In the configuration of Embodiment 2, by contrast with Embodiment 1, each conductor in the conductor group A has a tapered portion that extends continuously and gradually narrows from the end part of the portion having the width W1 in the conductor, which faces the terminal of the conductor group B, toward the terminal of the conductor group B. The tapered portion has a portion having a width W2 in the middle thereof, and is configured to overlap with each conductor of the conductor group B on the tip side from the portion having the width W2.

Here, when a small width W2 of the conductor group A shown in FIGS. 5A to 5C is to be formed by printing, it may not be possible to print a narrow conductor with sufficient shape accuracy due to production accuracy. As a result, it may not be possible to ensure overlapping between the conductor group A and the conductor group B, and poor conduction may occur.

Figure 7:
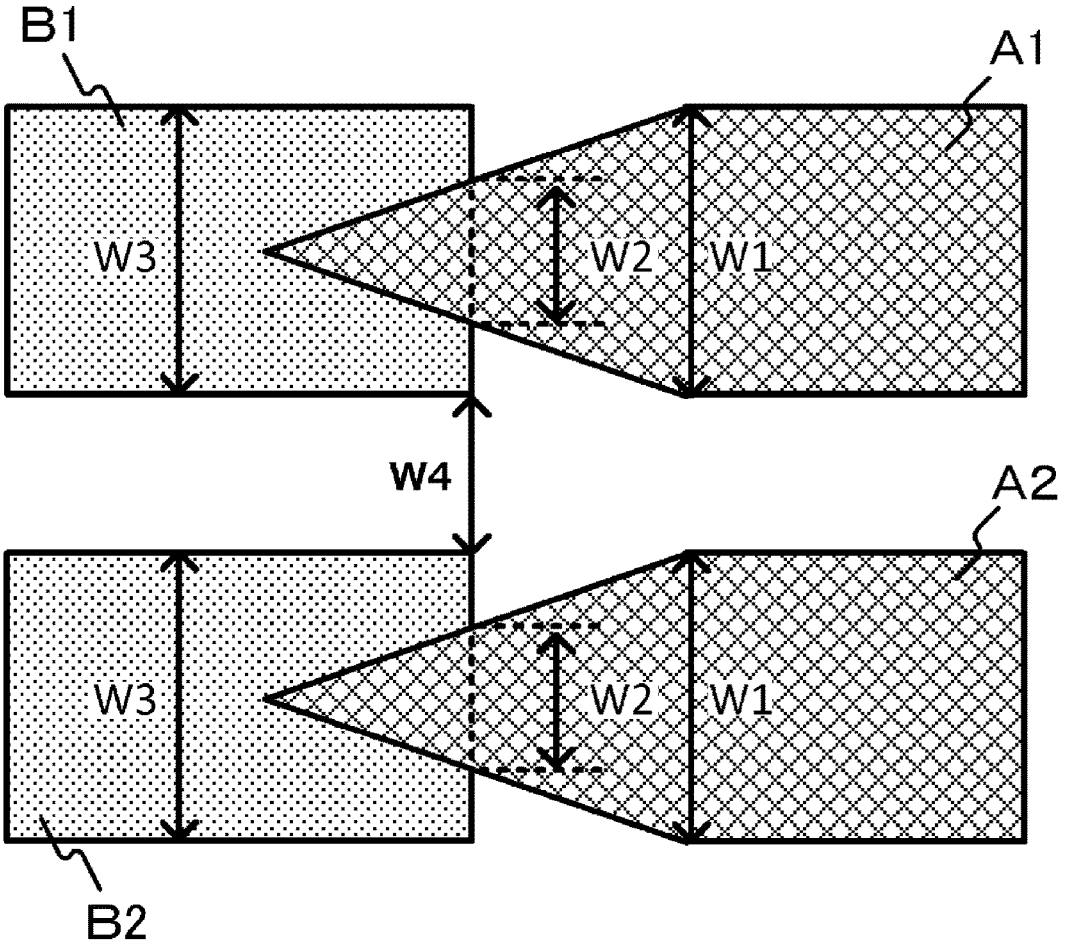
FIG. 7 is an explanatory diagram of a conductor pattern shape on the insulating substrate according to Embodiment 2.

Meanwhile, with the configuration of Embodiment 2 shown in FIG. 7, by continuously reducing the conductor width in the conductors of the conductor group A, it is possible to print the conductors easily and to increase the conductor strength of the conductor group A.

Embodiment 3

Figure 8A:
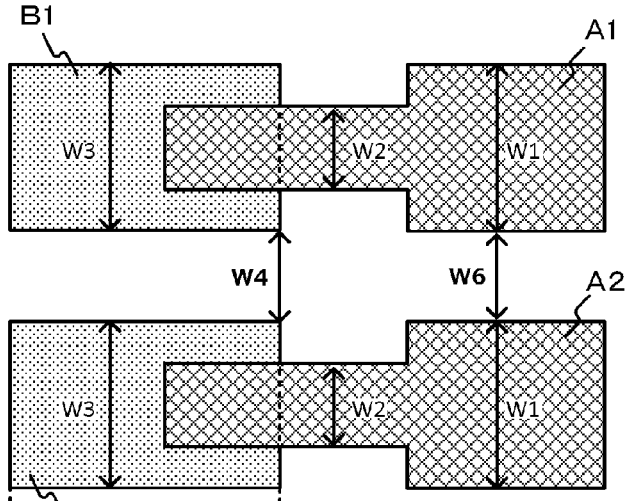
FIGS. 8A to 8C are explanatory diagrams of a conductor pattern shape on the insulating substrate according to Embodiment 3.
Figure 8B:
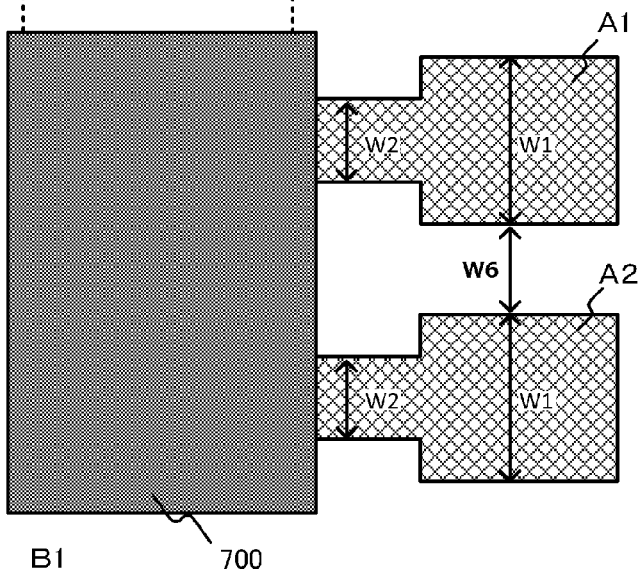
Figure 8C:
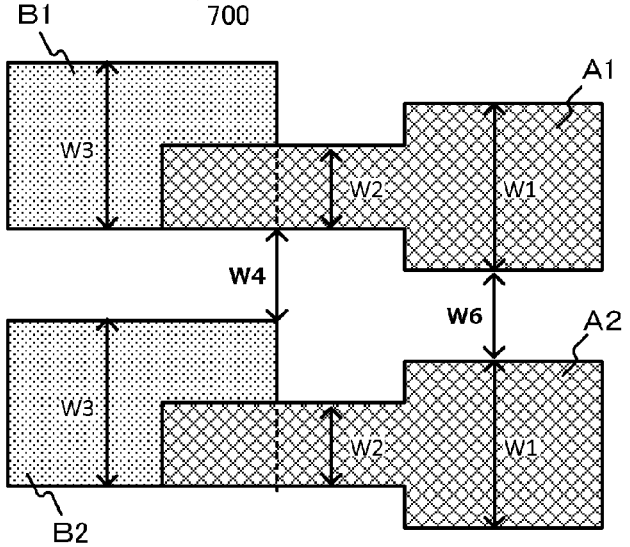

Embodiment 3 of the present invention will be described with reference to FIGS. 8A to 8C. Here, only features in Embodiment 3 that are different from those of the abovementioned embodiments will be described. In Embodiment 3, description of items common to the abovementioned embodiments will be omitted.

Embodiment 3 is configured, similarly to Embodiments 1 and 2, so that the width W2 of the conductor A in the overlapped portion of the conductor A and the conductor B is smaller than the widths W1, W3 in the conductors A, B. Further, the conductor group B is formed by printing at a conductor interval of a distance W4. The configuration of Embodiment 3 differs from those of Embodiments 1 and 2 in that the conductor group B is overlapped (covered) with glass 700 as an insulating protective layer.

The configuration of Embodiment 3 will be described with reference to FIGS. 8A to 8C. From the viewpoint of cost, silver (Ag) is selected as the conductor material to be used for the conductor group B, and a silver/palladium alloy (Ag/Pd) is selected as the conductor material to be used for the conductor group A to ensure compatibility with an electrode material (not shown) connected to the conductor group A.

Here, when a printing shift occurs in the width direction between the conductor group A and the conductor group B, the inter-conductor distance between the conductor A1 overlapping with the conductor B1 and the adjacent conductor B2 is reduced, and migration may occur between the conductor A1 and the conductor B2. By contrast, in Embodiment 3, as shown in FIG. 8B, the migration can be suppressed by overlapping the conductor material and the zone between the conductors where the migration is likely to occur with the glass 700.

Further, silver (Ag), which is the conductor material of the conductor group B, is disadvantageous from the viewpoint of migration, and therefore needs to be protected with glass. However, where the width W6 of the conductor group A can be ensured, no problem arises even without glass protection. Therefore, there is no migration problem even when a printing shift occurs, as shown in FIG. 8C, in the overlapping portion of the conductor group A and the conductor group B. Further, where a glass layer is provided on the thermistor surface, in the fixing device 100 shown in FIG. 2, the thermistor element surface can be set on the fixing nip side.

The above embodiments can be combined with each other if possible.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-051895, filed on Mar. 19, 2019, which is hereby incorporated by reference herein in its entirety.

What is claimed is:

1. A heater for using an image heating device, comprising:

a substrate having a longitudinal direction and a width direction;

a heating resistor provided on the substrate, and a plurality of electric conductors provided on the substrate, wherein the plurality of electric conductors include a conductor group A including a plurality of first electric conductors and a conductor group B including a plurality of second electric conductors;

wherein the plurality of first electric conductors and the plurality of second electric conductors are in contact with each other, wherein the plurality of first electric conductors each have a first portion having a width W1 and a second portion having a width W2 smaller than the width W1 and are provided on the substrate to be arranged side by side in a width direction of the substrate, wherein the plurality of second electric conductors each have a portion having a width W3 larger than the width W2 and are provided on the substrate to be arranged side by side in the width direction, and wherein as seen in a direction perpendicular to both the longitudinal direction and the width direction, the second portions of the first electric conductors and the portions having the width W3 partially overlap each other.

2. The heater according to claim 1, wherein a distance W4 between the plurality of second electrical conductors in the width direction is larger than the width W2.

3. The heater according to claim 1, wherein the plurality of first electric conductors have a third portion between the first portion and the second portion, the width of the third portion gradually changing from the width W2 to the width W1.

4. The heater according to claim 1, wherein the first electric conductor is formed of a material that is different from a material of the second electric conductor.

5. The heater according to claim 1, wherein at least one of the conductor group A and the conductor group B is covered with an insulating protective layer.

6. The heater according to claim 1, further comprising a plurality of temperature sensing elements provided on the substrate, wherein the plurality of electric conductors are used to extract signals of the plurality of temperature sensing elements.

7. An image heating device for heating an image formed on a recording material, comprising:

a heating unit having a heater for heating an image formed on the recording material, wherein the heater has a substrate having a longitudinal direction and a width direction, a heating resistor provided on the substrate, and a plurality of electric conductors provided on the substrate, wherein the plurality of electric conductors include a conductor group A including a plurality of first electric conductors and a conductor group B including a plurality of second electric conductors, wherein the plurality of first electric conductors and the plurality of second electric conductors are in contact with each other, wherein the plurality of first electric conductors each have a first portion having a width W1 and a second portion having a width W2 smaller than the width W1 and are provided on the substrate to be arranged side by side in the width direction of the substrate, wherein the plurality of second electric conductors each have a portion having a width W3 larger than the width W2 and are provided on the substrate to be arranged side by side in the width direction, and wherein as seen in a direction perpendicular to both the longitudinal direction and the width direction, the second portions of the first electric conductors and the portions having the width W3 partially overlap each other.

8. The image heating device according to claim 7, wherein a distance W4 between the plurality of second electrical conductors in the width direction is larger than the width W2.

9. The image heating device according to claim 7, wherein the plurality of first electric conductors have a third portion between the first portion and the second portion, the width of the third portion gradually changing from the width W2 to the width W1.

10. The image heating device according to claim 7, wherein the first electric conductor is formed of a material that is different from a material of the second electric conductor.

11. The image heating device according to claim 7, wherein at least one of the conductor group A and the conductor group B is covered with an insulating protective layer.

12. The image heating device according to claim 7, wherein the heater further includes a plurality of temperature sensing elements provided on the substrate, and wherein the plurality of electric conductors are used to extract signals of the plurality of temperature sensing elements.

13. The image heating device according to claim 7, further comprising a cylindrical film and a roller contacting an outer peripheral surface of the film, wherein the heating unit is in contact with the inner surface of the film, and wherein by sandwiching the film between the heater and the roller, a nip portion for pinching and conveying the recording material is formed between the film and the roller.

14. An image forming apparatus for forming an image on a recording material, comprising:

an image forming unit that forms an image on the recording material; and a fixing unit for heating the image to fix the image on the recording material, wherein the fixing unit is an image heating device that has a heating unit having a heater for heating an image formed on a recording material, the heater has a substrate having a longitudinal direction and a width direction, a heating resistor provided on the substrate, and a plurality of electric conductors provided on the substrate, and heats an image formed on a recording material using heat of the heater;

wherein the plurality of electric conductors include a conductor group A including a plurality of first electric conductors and a conductor group B including a plurality of second electric conductors, wherein the plurality of first electric conductors and the plurality of second electric conductors are in contact with each other, wherein the plurality of first electric conductors each have a first portion having a width W1 and a second portion having a width W2 smaller than the width W1, and are provided on the substrate to be arranged side by side in the width direction of the substrate, wherein the plurality of second electric conductors each have a portion having a width W3 larger than the width W2, and are provided on the substrate to be arranged side by side in the width direction, and wherein as seen in a direction perpendicular to both the longitudinal direction and the width direction, the second portions of the first electric conductors and the portions having the width W3 partially overlap each other.

* * * * *